US005186230A

United States Patent [19]

Ostrander

[11] Patent Number: 5,186,230

[45] Date of Patent: Feb. 16, 1993

[54] MECHANISM FOR OPERATING BI-FOLD DOORS

[76] Inventor: Robert F. Ostrander, 1 Doc's Hill Rd., Westbrook, Conn. 06498

[21] Appl. No.: 741,063

[22] Filed: Aug. 6, 1991

[51] Int. Cl.[5] ..... E05D 15/26

[52] U.S. Cl. ..... 160/206; 160/199; 16/72

[58] Field of Search ..... 160/199, 206, 213; 16/72

[56] References Cited

U.S. PATENT DOCUMENTS

| | | | |
|---|---|---|---|
| 367,020 | 7/1887 | Barlow | 16/72 X |
| 369,203 | 8/1887 | O'Daniel | 16/72 |
| 376,435 | 1/1888 | Harrison | 16/72 |
| 1,328,961 | 1/1920 | Martin . | |
| 1,508,524 | 9/1924 | Olson . | |
| 1,771,299 | 7/1930 | Justus . | |
| 1,773,634 | 8/1930 | Schneider . | |
| 2,024,919 | 12/1935 | Fredricks et al. | 16/72 |
| 2,101,147 | 12/1937 | Lux . | |
| 2,217,878 | 10/1940 | Walrath | 16/72 |
| 2,441,455 | 5/1948 | Tetzman . | |
| 2,581,797 | 1/1952 | Jordan . | |
| 3,039,134 | 6/1962 | Rudnick . | |
| 3,181,596 | 5/1965 | Winnan et al. . | |
| 3,409,341 | 11/1968 | Pickard . | |
| 3,437,125 | 4/1969 | Hargroue . | |

*Primary Examiner*—Blair M. Johnson

[57] ABSTRACT

The invention comprises a mechanism for aiding in the closing of a bi-fold door, and for maintaining the door in a closed position, which includes a door frame having vertically spaced apart frame members, an upper horizontal frame member extending between said vertical frame members, the frame members defining an opening in a wall, a pair of bi-fold doors hinged together at adjacent edges adapted to at least partially close the opening, one of the doors of each pair being in a fixed position to pivot about points at the top and bottom thereof adjacent one of the vertical frame members, a guide and supporting track extending longitudinally along the length of the upper frame member, a roller member extending upwardly from the other of the inner doors into the track and being guided thereby in the track whereby the other of the doors at the free end thereof has sliding longitudinal movement in the track and the pair of doors may move from an open position in which they are in a generally V-shape into a closed position where they are in an in-line closed position to close the opening, comprising, a bracket member mounted within said opening and offset from the pivotal points of the one door, a spring attached at one end thereof to the bracket member and the other end thereof attached to the one of the doors at a point spaced inwardly from the pivotal points of the one end of the one door. The point of connection of the spring to the bracket and to the one door being such that as the pair of doors are opened, the spring has energy stored therein to aid closing the door, the spring being so chosen and arranged as to have energy stored therein so as to maintain the one door in a closed position absent an opening force exerted on the pair of doors.

1 Claim, 5 Drawing Sheets

MECHANISM FOR OPERATING BI-FOLD DOORS

FIELD OF THE INVENTION

This invention relates to bi-fold doors and more particularly relates to a unique and simplified mechanism for holding the bi-fold doors in a closed position yet aiding the return of the bi-fold door to a closed position.

BACKGROUND OF THE INVENTION

Bi-fold doors are commonly used as doors for closets or storage areas where a person opens a door for access to an area in only one direction.

Typically, a bi-fold door comprises four panels or doors in two sets. One advantage of bi-fold door pairs is that they may cover an opening of up to sixty to seventy two inches in which case each door panel measures essentially one quarter of the total opening. This permits the opening of the doors to a closet or storage area where, when fully opened both pairs of doors will only extend essentially one quarter of the distance of the opening into the room or hall from where the doors are opened. Typically, where four doors are used they are arranged in pairs where the doors of each pair are hinged to each other so as to fold outwardly from the opening. The outer door of a pair is pivotally connected at its top and bottom and a channel guide or track is provided on the upper horizontal member of the door frame or jam. The inner door of a pair has a bushing or roller attached thereto and extending upwardly therefrom adjacent the free end thereof which moves in the upper guide channel. The inner door of a pair is supported from the outer door. In some cases, where a smaller opening is provided only one pair of bi-fold doors may be utilized. Hand grips or handles are provided adjacent the hinged edges of the inner doors of a pair for gripping by a person and upon pulling by the person will outwardly fold each set of bi-fold doors to expose the closet or storage area.

The general purpose of the closet door or a door to other storage area may be considered to be to prevent accumulation of air born dust on clothing or other stored articles as well as to inhibit the entrance of insects such as moths thereto. These purposes also must be considered subservient to aesthetically covering a storage area and separating such storage area from the general part of a room such as a bedroom or an entrance hall.

Bi-fold doors do require manipulation by hand of each pair of doors and often the user must use two hands to effect closing of both pairs of a bi-fold door where two pairs are involved. Additionally, it is generally desirable to have the doors completely closed and remained in a completely closed position when access to the storage area is not desired. It is considered by some to be a nuisance to close both sets of bi-fold doors.

These problems with bi-fold doors as to closure thereof and maintaining in a closed position have been addressed in U.S. Pat. Nos. 3,181,596; 3,437,125; 3,116,782; but all of these patents disclose rather relatively complex mechanisms to achieve a very simple function. For example, U.S. Pat. No. 3,116,782 discloses a spring arrangement connected between a bi-fold door pair at hinged edges and requires routing of depressions for brackets for holding the springs. U.S. Pat. No. 3,181,596 requires a lever connected to the inner unit of a bi-fold door sliding on the upper support track and connected to a bi-fold door. U.S. Pat. No. 437,125 discloses a bi-fold door closer which is mounted within the door and comprises a pneumatically operated cylinder device which produces a restoring force on a cable which is attached to the innermost door.

As discussed these prior art closures and holders for bi-fold doors are rather complex and in some cases may be more expensive that the bi-fold doors themselves.

Accordingly, the present invention provides a new, novel and unique device for aiding in the closing and holding closed of bi-fold doors which is very simple in operation and requires very few parts.

An object of this invention is to provide a new and improved closing mechanism for a bi-fold door.

Another object of this invention is to provide a new and improved closing mechanism door which is easy to install and which lends itself to simple adjustment.

SUMMARY OF THE INVENTION

The invention comprises a mechanism for aiding in the closing of a bi-fold door, and for maintaining the door in a closed position, which includes a door frame having vertically spaced apart frame members, an upper horizontal frame member extending between the vertical frame members, the frame members defining an opening in a wall, a pair of bi-fold doors hinged together at adjacent edges adapted to at least partially close the opening, one of the doors of each pair being in a fixed position to pivot about points at the top and bottom thereof adjacent one of the vertical frame members, a guide or track extending longitudinally along the length of the upper frame member, a roller member extending upwardly from the other of the inner doors adjacent the free end thereof into the track and being guided thereby in the track whereby the other of the doors at the free end thereof has sliding longitudinal movement in the track as well as pivotal movement and the pair of doors may move from an open position in which they are in a generally V-shape into a closed position where they are in an in-line closed position to close the opening, comprising, a bracket member mounted within the opening and longitudinally offset from the pivotal points of the one door, a spring attached at one end thereof to said bracket member and the other end thereof attached to the one of the doors at a point spaced from the pivotal points of the one end of the one door.

The point of connection of the spring to the bracket and to said one door are such that as the pair of doors are opened the line of direction of said spring may move over an imaginary line extending perpendicular from the point of attachment of the spring to the door and the spring has energy stored therein to aid closing the door, the spring being so chosen and arranged as to have energy stored therein so as to maintain the one door in a closed position absent an opening force exerted on the pair of doors.

The features of the invention which are believed to be novel are particularly pointed out and distinctly claimed in the concluding portion of this specification. The invention, however, together with further objects and advantages thereof may best be appreciated by reference to the following detailed description taken in conjunction with the drawings.

DETAILED DESCRIPTION OF PREFERRED EMBODIMENT OF THE INVENTION

Figure 1:
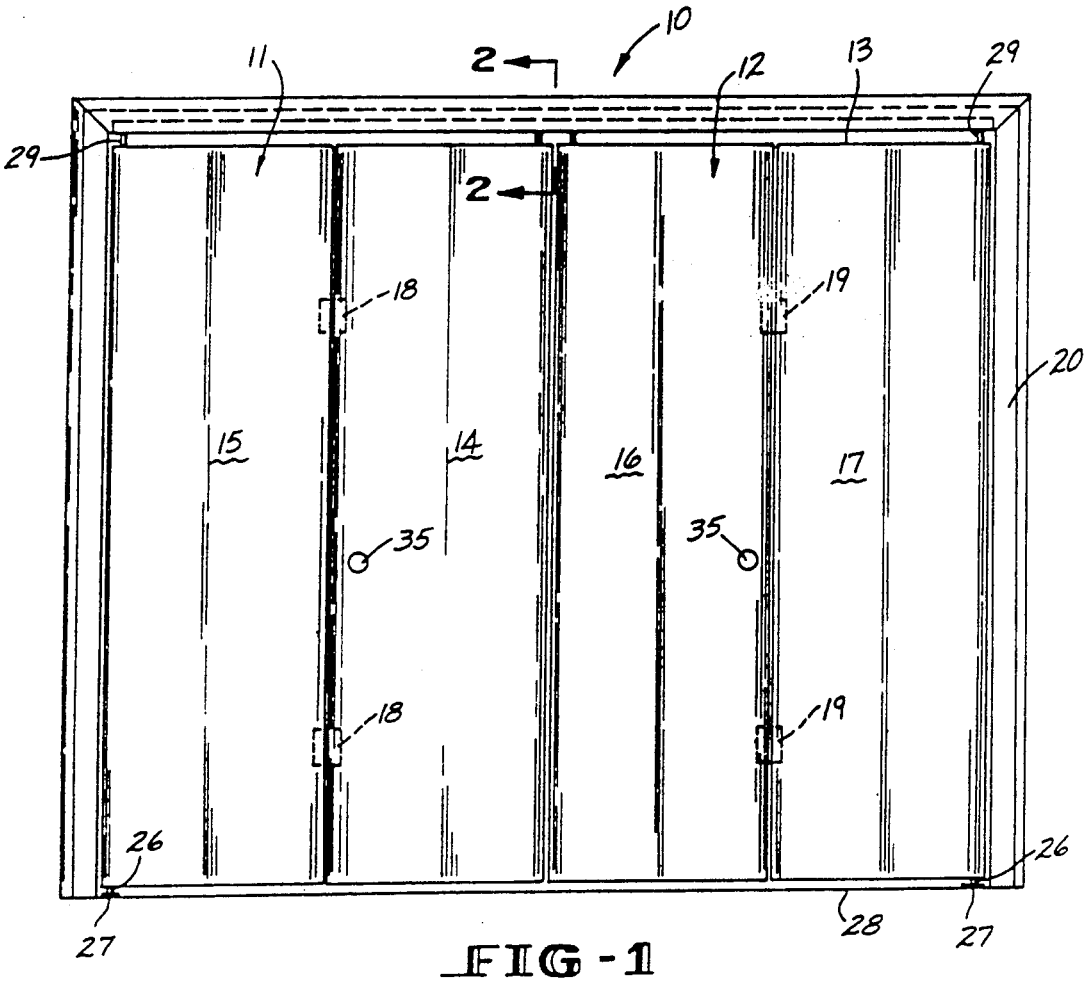
FIG. 1 is a front elevation of a bi-fold door arrangement with the bi-fold doors closed.

FIG. 1 illustrates a bi-fold door arrangement 10 comprising a pair of bi-fold doors 11 and 12 closing opening 13. Bi-fold door pair 11 comprises a inner door 14 and an outer door 15 while bi-fold pair 12 comprises an inner door 16 and an outer door 17. Each pair of doors are hinged together usually with hinges that are not exposed as exemplified by upper and lower hinges 18 connecting doors 14 and 15 and upper and lower hinges 19 connecting doors 16 and 17. The hinges which are shown in dotted line inasmuch as they are not exposed. Various types of hinges are used on bi-fold door pairs. The bi-fold door pair 10 and the opening 13 are surrounded by the conventional decorative trim molding 20 comprising two vertical and an upper section.

Figure 2:
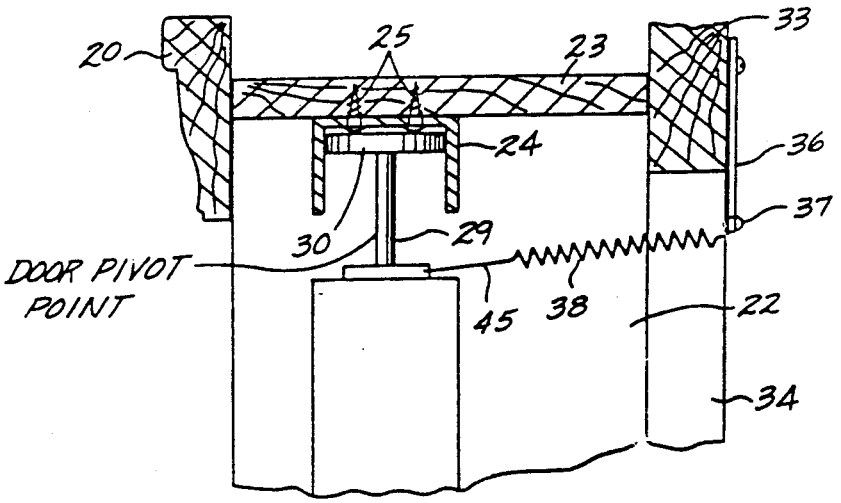
FIG. 2 is a sectional view seen in the lines of plane 2—2 of FIG. 1.

Reference is now also made to FIG. 2 in conjunction with FIG. 1. The bi-fold door set as installed includes a pair of side frames 22 (only one shown) and a top frame 23 that are interconnected to define the rectangular opening 13 in conjunction with the floor of the structure.

A guide or track member of generally inverted U-shape 24 runs substantially the length of opening 13 and is affixed to top member 23 as for example by means of screws 25 at spaced apart positions along the length of member 23.

The outer doors while they may rotate or pivot do not move longitudinally in the guide 24. The outer doors 15 and 17 in one configuration receive a pin 26 in the bottom thereof which extends into a bracket 27 affixed to the floor generally indicated by the line 28. The outer doors 15 and 17 have pins 29 extending from the top edge thereof into a bracket which is fixed in guide member 24 of the ends thereof. Extending adjacent the free ends of inner doors 14 and 16 are rollers 30 on a shaft 29 which roll on and between the vertical legs of guide 24.

The opening 13 and the frame members 22 and 23 are generally concealed from the inside.

The inside of opening 13 is generally finished by means of an upper casing member 33 and vertical casing members 34 (only one shown, FIG. 2).

To operate the either one or both of the bi-fold pair of doors 11 and 12 an outward pulling force is exerted on knobs or handles 35 shown as attached adjacent the hinged edges of the inner doors. This will produce pivotal movement about the hinges 18 or 19 and the outer doors and also the inner doors will pivot towards a position generally shown in FIG. 5. The outer doors will pivot about the points 26 and 29 and the inner doors will both pivot and translate by virtue of the hinges 18 and 19 and the rollers 30 to open the doors and expose the entry way 13. The knobs or handles 35 may alternatively be attached to the outer doors adjacent the hinged edges thereof.

What has just been described is conventional construction and operation of bi-fold doors which normally close the entry to a closet or other type of storage area.

As previously described all bi-fold doors must be manually operated and opened and then manually reclosed to cover the entry way exemplified by the reference numeral 13 in FIG. 1.

The present invention provides a new and improved mechanism for closing a bi-fold door pair after it has been opened.

Returning now to FIG. 2, in accordance with the present invention means are provided for returning a pair of bi-fold doors to a closed position. A bracket member 36 as hereinafter exemplified is attached to upper casing member 33, as will hereinafter be described, and depends therebelow. Bracket member 36 depends below member 33 for securing an end 37 of a spring 38, thereto at one of a plurality of points.

The spring 38 in an extended position provides a restoring force in that the person opening the bi-fold doors merely has to exert a slight force on the handle or knob 35 toward a closing position to enable closing of the doors, and thereafter the energy stored in the extended spring returns the door pair to the closed position.

Figure 3:
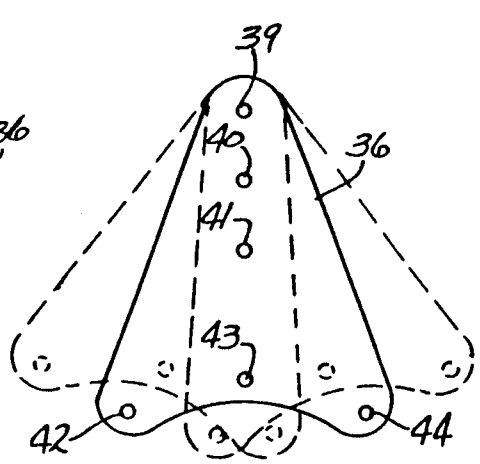
FIG. 3 is an elevational view of the bracket.

Reference is now made to FIG. 3 which shows bracket 36. Bracket 36, in a preferred form, is generally triangular in shape and includes multiple holes 39, 40 and 41, for receiving securing screws into casing member 33 and also includes apertures 42, 43 and 44 as attachement apertures for the end 37 of spring 38, as hereinafter described. The bracket 36 may be attached to casing member 33 by anyone of screw holes 39, 40, or 41 and then pivoted to dimensionally locate any one of apertures 42, 43, or 44 a given distance from frame member 22.

Figure 4:
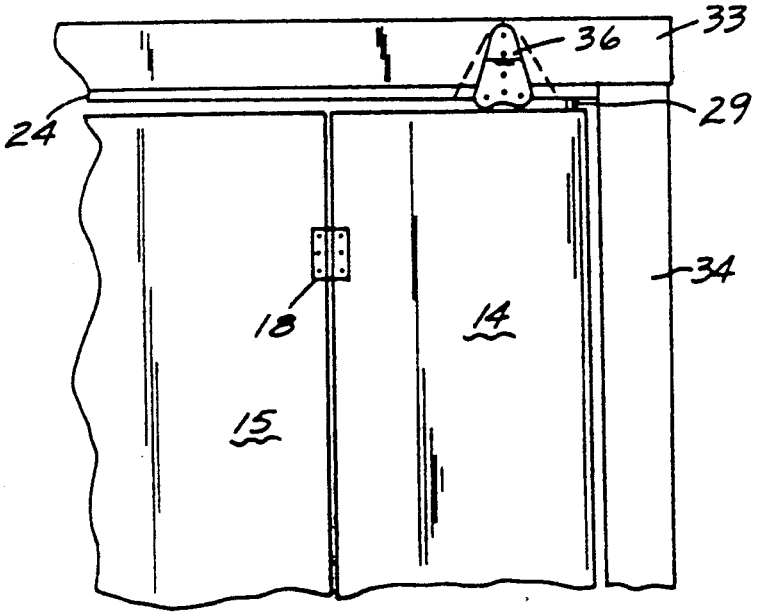
FIG. 4 is a partial elevational view of a bi-fold door pair seen from the rear as represented in FIG. 1.

An end 45 of spring 38 is extended linearly beneath guide 24 and is attached by means of a screw or other suitable securing device 46 to the top edge of the outer doors exemplified in FIG. 4 as door 15.

Figure 5:
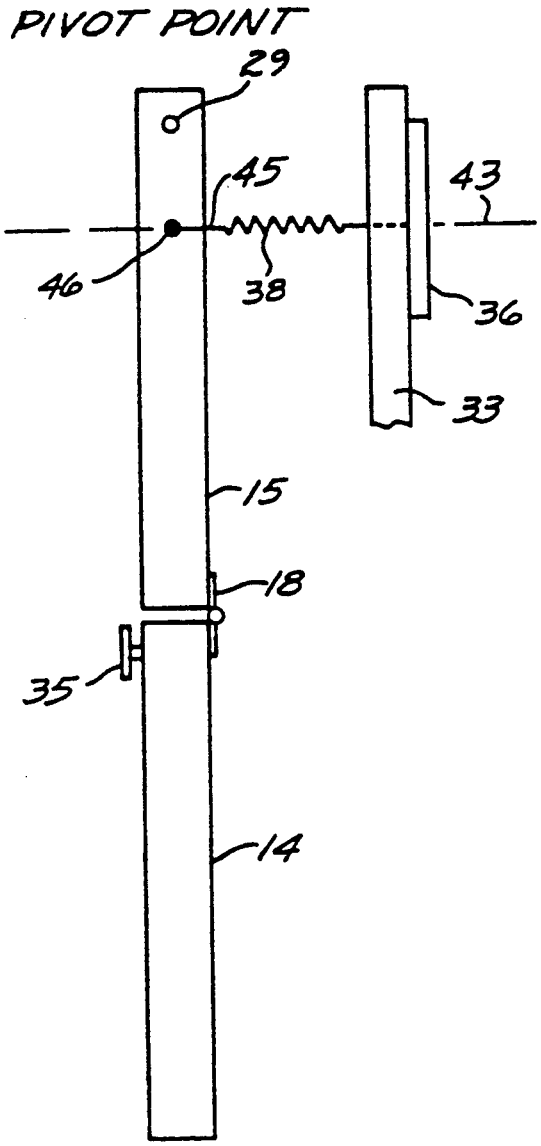
FIG. 5 is a partial top view of a bi-fold door pair as shown in FIG. 1.

The tension in spring 38 both when a door pair is in a closed position and when in an open position as shown in FIG. 5 maybe adjusted by the location of the end 37 of spring on bracket 36 and also the location of point 46. This can also be adjusted by the selection of spring 38 both as to length and also the spring constant.

As shown in FIG. 3, bracket 36 may be attached to upper casing member at any one of holes 39, 40, or 41 and may be pivoted to various positions exemplified in dotted line as 36' and 36''. This will also vary the positions of apertures 42, 43, and 44 with respect to the distance from a vertical frame member 22.

Figure 6:
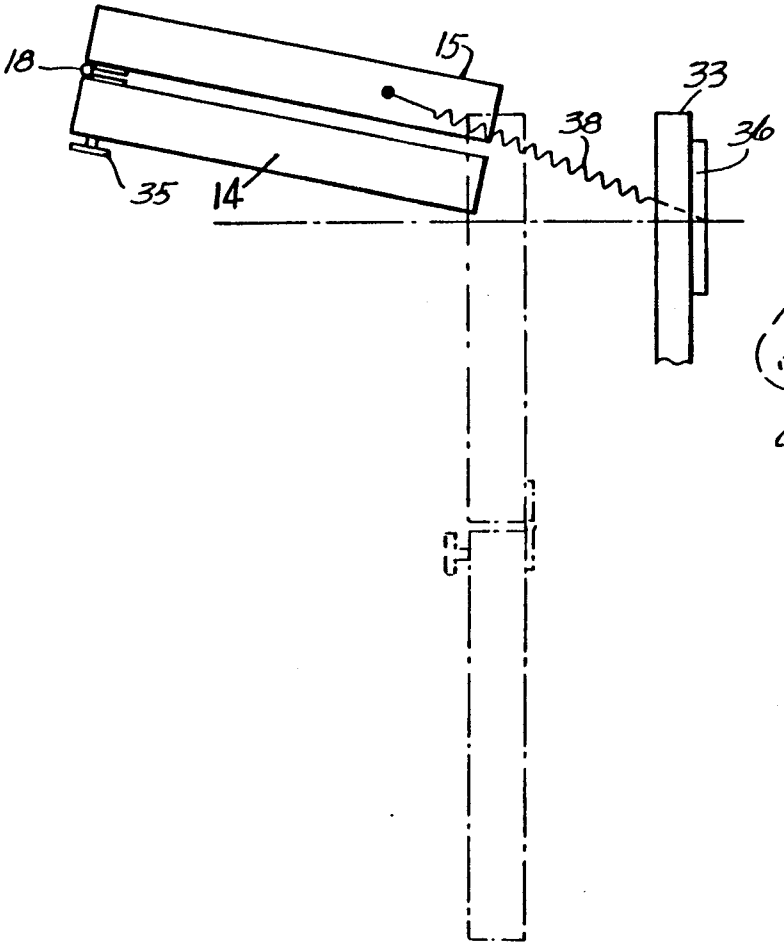
FIG. 6 is a top view similar to FIG. 4 but showing the bi-fold door pair of FIG. 1 in a partially open position.

The end result is to vary the tension in spring 38, when a door pair is in a closed position as shown in FIG. 5, and in an open position as shown in FIG. 6.

The spring, in one form of the invention, is attached to bracket 36 and to door 15 along an imaginary line 43 which is essentially perpendicular to the plane of the overall bi-fold door pairs 11 and 12 when the doors are in a closed position. The spring 38 as positioned will attach to door member 15 beneath guide 24. The spring 38 as attached to the bracket 36 and to the door 15 at point 46 has sufficient tension therein so as to maintain door 15 in a closed position so it might not buckle under ordinary stress.

The spring 38 in its coiled portion is of small diameter and will not interfere in the clearance space between the top of the outer doors 15 or 17 and the track or guide 24. As may be exemplified in FIG. 5 when door 14 and 15 are open the spring moves over the center line 43 and is further tensioned and has energy stored therein. Then after the door pair, as exemplified 14 and 15, are opened as shown in FIG. 6, upon a slight movement by a person, who wishes to close a pair of bi-fold doors, by exerting a force on knob or handle 35 will cause spring to release the energy stored therein and move the bi-fold door pair back to a closed position. Because of the energy stored therein by the tension in a closed position, spring 38 will hold the door closed.

Figure 7A:
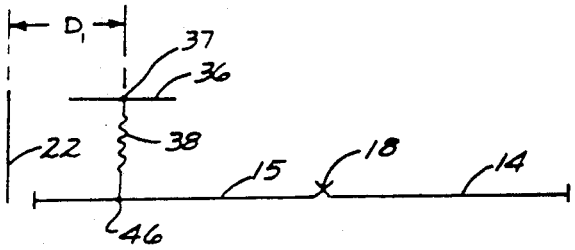
FIGS. 7*a, b*, 8*a, b*, and 9*a, b*, schematically exemplify operation of a mechanism embodying the invention.
Figure 7B:
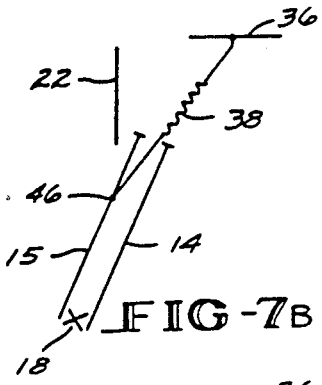
Figure 8A:
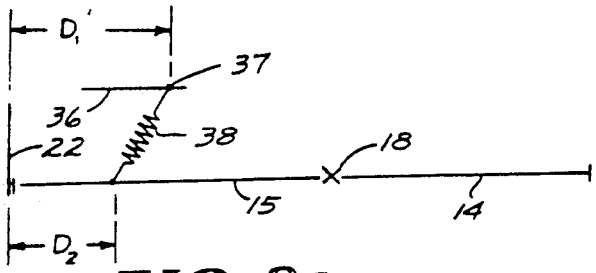
Figure 8B:
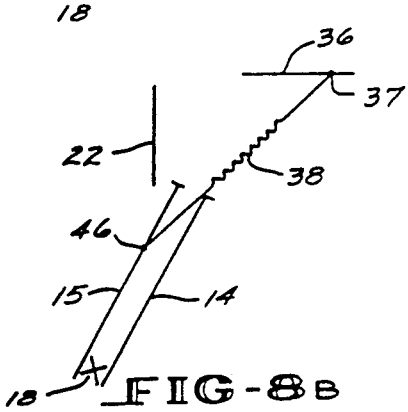
Figure 9A:
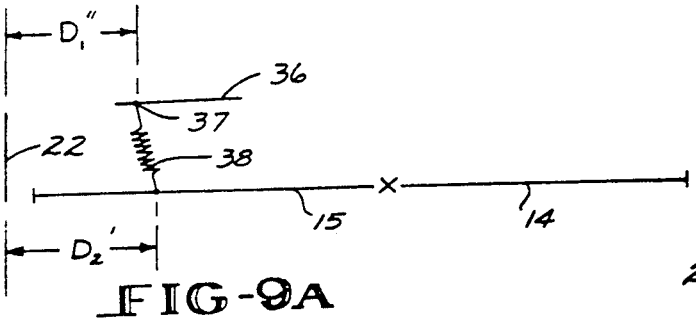
Figure 9B:
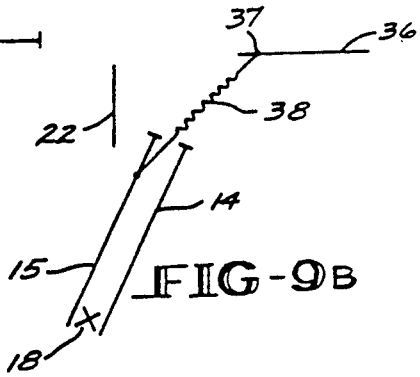

The position of the spring attachment 46 to door 15 may be varied as previously discussed and as shown in FIGS. 7, 8 and 9 as to vary tension in the spring 38 and therefor the restoring force exerted thereby. A person opening a pair of bi-fold doors may wish to have the spring be in a position to return the bi-fold doors to a closed position merely by applying a small force to a knob or handle 35 in which case the spring will take over the closing force, or the person may wish to open the bi-fold doors where the spring exerts a restoring force which will close the door unless the person holds the door open while gaining access to the area behind the door.

FIGS. *7a* and *7b* in schematic form correspond to FIGS. 5 and 6, where the axis of spring 38 is coincident with imaginary line 43. Here, the spring 38 has some energy stored therein to hold the door in a closed position (FIGS. 5 and *7a*). However, when the door is in an open position (FIGS. 6 and *7b*) spring 38 does not have sufficient energy stored therein to return the door pair 14 and 15 to a closed position. But, a slight closing force exerted on knob 35 will start the door toward a closing position and the energy stored in spring 38 will close the door. As exemplified in FIGS. *7a* and *7b*, the end 37 of spring 38 is connected at aperture 43 in bracket 36 which is a distance $D_1$ from vertical frame member 22, as is point 46. The foregoing discussion assumes a given spring constant.

In the embodiment shown in FIGS. *8a* and *8b*, it will be noted that the attachment point of end of spring 38 has been moved to a distance $D_1'$ from frame member 22. This would correspond to the end 37 of spring 36 being attached at aperture 44 of bracket 36 as shown in FIG. 3. In this arrangement spring 38 will be greater extended and have more energy stored therein. The result will be that the person opening a door pair will have to exert a slight hold open force on the door and when the hold open force is released, spring 38 will return a door pair to a closed position by virtue of the energy stored therein.

The bracket 36 with the spaced apart apertures 42, 43, and 44 therein permits the dimension $D_1$ to be varied, and the point of attachment of spring end 40 may be varied as exemplified by the distances $D_2$ and $D_2'$ in FIGS. *8a* and *9a* respectively, to determine the stress placed on spring 38 and the resultant energy stored therein when a door pair is opened to the positions shown in FIGS. *8b* and *9b*.

The bracket 36 may also be pivoted about a point of attachment at one of screw holes 40, 41 or 42 and the bracket pivoted to vary the distance $D_1$, and hence the amount of energy stored in the spring 38 when a door pair is opened. Similarly, the distance $D_2$ may be varied as shown by $D_2'$ in FIG. *9a*, where the end 37 of spring 38 is captured in aperture 42 of bracket 36.

The distance $D_1$ and $D_2$ may be variable as shown as well as the spring constant of spring 38 to provide the desired return force exerted on doors 15 or 17. The overall length of spring 38 will be determined by the width of side frames 22, the distance $D_2$, and the spring constant.

It will be apparent from the schematic diagrams of FIGS. 7, 8 and 9 that the point 46 of attachment of the spring 38 to the outer door 15 will contribute determining the energy which is stored in the spring 38 upon the opening of a pair of the bi-fold doors and therefor the restoring force exerted by the spring 38. Therefore, the spring may be adjusted in position so as to determine the energy stored therein when a pair of bi-fold doors is opened and whether it is desired merely to have the spring store energy therein such that it will return the door upon a slight force exerted on a knob 35 or whether the person opening the door will have to hold the door open and upon release the spring 36 will close the door in view of a larger degree or energy stored therein due to the point of connection 42 to an outer door.

This may be dependent upon the user of the door. As shown in FIG. 3, bracket 36 is adapted to be attached to a member 33 at any one of a plurality of positions perhaps by a single screw and then rotated about such screw to the various positions shown in FIGS. 3 and 4. This may vary the position dependent on whether the spring is attached to the openings 42, 43 or 44 and the angular position of bracket 36 may determine the energy that will be stored in the spring 38 and therefor the degree of return force, and further determine whether the person opening the door will have to give a slight return force to the door or whether the door will automatically close upon release of a holding effort on the door.

If bracket 36 is pivoted clockwise aperture 42 will move upwardly to position end 37 of spring 38 at a given level. The same holds true for aperture 44 if bracket 36 is pivoted counterclockwise, as viewed in FIG. 3.

It may thus be seen that the objects of the invention set forth, as well as those made apparent from the foregoing description, are efficiently attained. While a preferred embodiment of the invention has been set forth for purposes of disclosure, modifications to the disclosed embodiment of the invention, as well as other embodiments thereof, may occur to those skilled in the art. Accordingly, the appended claims are intended to cover all embodiments of the invention and modifications to the disclosed embodiment which do not depart from the spirit and scope of the invention.

What is claimed is:

1. A mechanism for aiding in the closing of a bi-fold door which includes a door frame having vertically spaced apart frame members, an upper horizontal frame member extending between said vertical frame members, said frame members defining an opening in a wall, a pair of doors hinged together at adjacent edges adapted to at least partially close the opening, one of the doors being in a fixed position to pivot about points at the top and bottom thereof adjacent one of said vertical frame members and having a top edge, a guide and supporting track extending longitudinally along the length of the upper frame member, a roller member extending upwardly from the other of said doors into the track and being guided thereby in said track whereby said other of the doors at the free end thereof has sliding longitudinal movement in said track and said pair of doors may move from an open position in which they are in a generally V-shape into a closed position where they are in an in-line closed position to close the opening, comprising, a bracket member mounted within said opening and offset from the pivotal points of the one door within the opening, a spring having two ends, one end attached at one end thereof to the bracket member and the other end thereof attached to the one of said doors at said top edge thereof at a point spaced inwardly from the pivotal points of said one end of said one door, the point of connection of the spring to the bracket member and to the one door being such that as the pair of doors are opened the spring is tensioned and has energy stored therein to aid closing said door, said bracket member including a plurality of first and second points of attachment, a selected one of said first points of attachment mounting said bracket member to the frame, a selected one of said second points to attachment engaging said spring, the spring and the respective selected points of attachment being selected to achieve a desired closing characteristic of said closing mechanism.

* * * * *